US006789788B2

(12) United States Patent
Belke

(10) Patent No.: US 6,789,788 B2
(45) Date of Patent: Sep. 14, 2004

(54) DEVICE FOR A FLOTATION MACHINE

(75) Inventor: Jeffrey Belke, Palmyra (AU)

(73) Assignee: Outokumpu Oyj, Espoo (FI)

( * ) Notice: Subject to any disclaimer, the term of this patent is extended or adjusted under 35 U.S.C. 154(b) by 169 days.

(21) Appl. No.: 10/168,737

(22) PCT Filed: Dec. 20, 2000

(86) PCT No.: PCT/FI00/01125

§ 371 (c)(1),
(2), (4) Date: Sep. 25, 2002

(87) PCT Pub. No.: WO01/49388

PCT Pub. Date: Jul. 12, 2001

(65) Prior Publication Data

US 2003/0121241 A1 Jul. 3, 2003

(30) Foreign Application Priority Data

Dec. 30, 1999 (FI) ..... 1999 2816

(51) Int. Cl.[7] ..... B01F 3/04
(52) U.S. Cl. ..... 261/87; 210/221.2
(58) Field of Search ..... 261/83, 84, 85, 261/87, 91, 93; 210/221.2

(56) References Cited

U.S. PATENT DOCUMENTS 2,193,934 A * 3/1940 Moores ..... 261/32
2,198,143 A * 4/1940 Weinig ..... 261/87
3,377,025 A * 4/1968 Nye ..... 239/16
3,464,552 A * 9/1969 Warman ..... 209/170
3,584,840 A * 6/1971 Fuchs ..... 210/101
3,772,192 A * 11/1973 Huckstedt et al. ..... 210/704
4,425,232 A * 1/1984 Lawrence et al. ..... 210/219
4,551,285 A * 11/1985 Jackson ..... 261/87
4,618,427 A * 10/1986 Ven.ang.s ..... 210/629
4,624,777 A * 11/1986 Kallioinen et al. ..... 209/170
5,039,400 A * 8/1991 Kallioinen et al. ..... 209/164
5,251,764 A * 10/1993 Niitti et al. ..... 209/169

* cited by examiner

*Primary Examiner*—C. Scott Bushey
(74) *Attorney, Agent, or Firm*—Smith-Hill and Bedell

(57) ABSTRACT

The invention relates to a device for a flotation machine in which a drive shaft for mixing slurry and transporting air is driven by a drive arrangement and the drive shaft is provided with a bearing assembly and the drive shaft is at least partly hollow in the interior for transferring air to a rotor. According to the invention the drive shaft is provided with at least one bearing in a housing separated from at least one element forming an air transfer chamber around the drive shaft. Further, the drive shaft has at least one opening in order to create an essentially continuous connection between the air transfer chamber and the interior of the drive shaft.

5 Claims, 1 Drawing Sheet

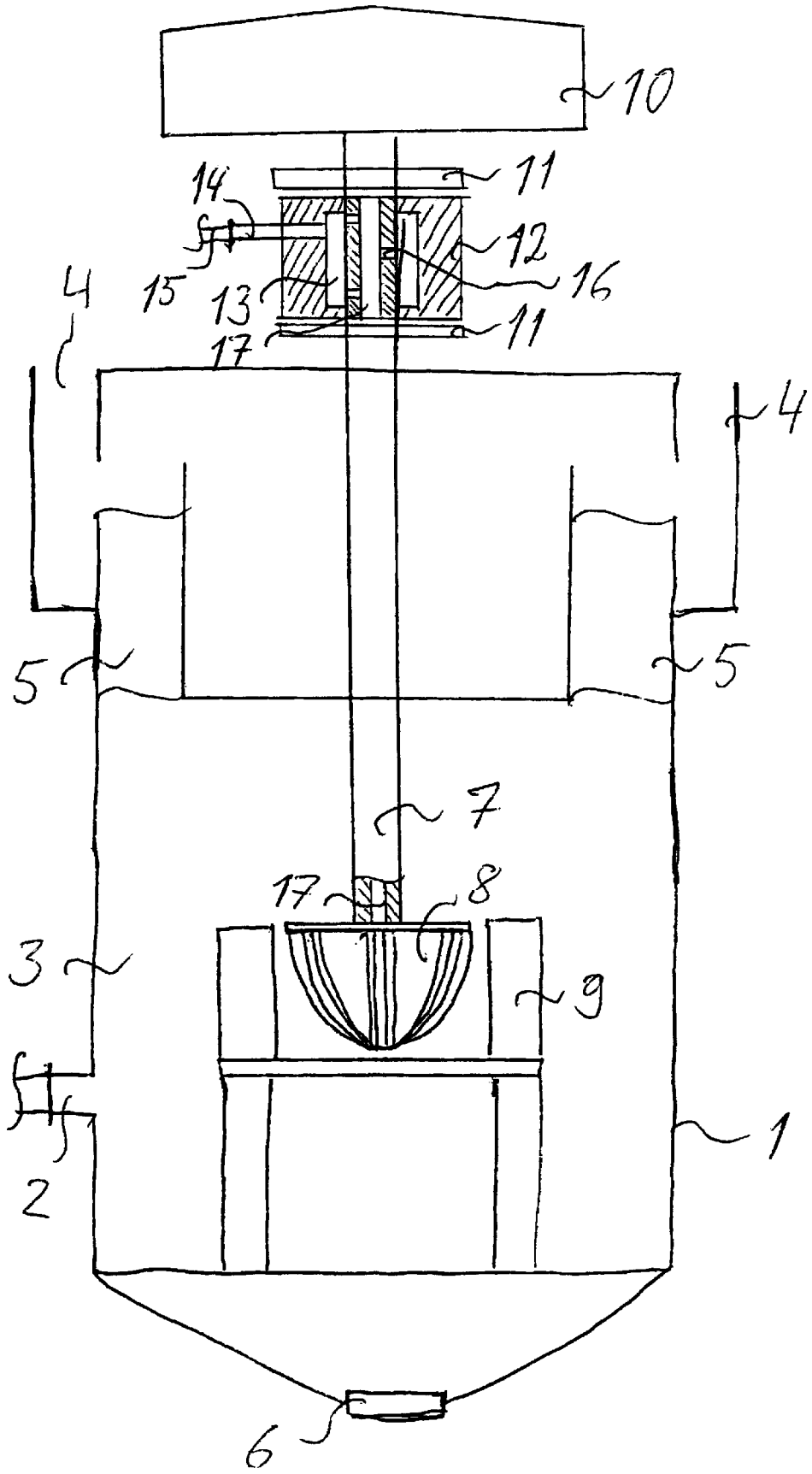
10
11
14
12
15
13
16
11
17
4
4
5
5
7
17
8
3
9
1
2
6

DEVICE FOR A FLOTATION MACHINE

The invention relates to a device for a flotation machine, particularly to a bearing assembly of a drive shaft of the flotation machine. The bearing assembly contains one or more bearings and an air transfer chamber separated from the bearing or bearings.

In a flotation machine a drive shaft is used to support the submerged mechanism which mixes slurry as well as for feeding air to the flotation machine. Then the drive shaft is hollow so that air is transferred inside the drive shaft to the rotor installed on the end of the drive shaft. By mixing and air feeding a part of the slurry containing for instance desired valuable metal or minerals is flotated and this flotated part of the slurry is removed from the flotation cell as an overflow via a froth lip in the upper part of the flotation cell. The non-flotated part of the slurry is removed from the flotation cell for instance through a bottom outlet of the flotation cell. Slurry is fed into the flotation cell in an essentially continuous fashion so that slurry to be fed will replace flotated and non-flotated parts removed from the flotation cell.

The drive shaft of the flotation machine has a bearing housing which is usually manufactured as a single casting. The casting of the bearing housing is then machined out to take the bearings and lip seals so that the air transfer chamber is between the bearings and the lip seals in the same casting. Thus the bearings, the lip seals and the air transfer chamber are combined with each other. When a bearing or a lip seal is needed to be changed the whole combination of the bearings, the lips seals and the air transfer chamber have to be removed from the drive shaft. Further, because the assembly of the bearing housing is difficult and requires a person well trained in the art, the maintenance of the bearing assembly will be expensive and takes time.

The object of the present invention is to eliminate some drawbacks of the prior art and to achieve a new device for the bearing assembly of the drive shaft in a flotation machine which device is simpler as its construction and easier and cheaper to maintain. The essential features of the invention are enlisted in the enclosed claims.

According to the invention a drive shaft for a flotation machine is used for mixing and transporting the air to a rotor in the flotation cell of the flotation machine. The drive shaft is advantageously provided with a rotor at that end of the drive shaft which is submerged in the slurry in the flotation cell. At the end or in the vicinity of the end of the drive shaft opposite to the end submerged in the slurry the drive shaft is connected with a drive arrangement. The drive shaft is driven by the drive arrangement for mixing the slurry in the flotation cell. Air to be used in the flotation process for forming froth in the flotation cell is fed through the drive shaft so that air is dispersed into slurry via the rotor blades. The drive shaft is thus hollow in its interior at least in that part where air is transported to the rotor. In order to stabilise the drive shaft for slurry mixing the drive shaft is provided with at least one bearing, advantageously in the vicinity of the drive arrangement.

In the preferred embodiment of the invention the drive shaft of the flotation machine is provided with two bearings installed in the vicinity of the drive arrangement. The bearings have separate bearing housings. Between these bearing housings a separate air transfer chamber is installed around the drive shaft. The air transfer chamber is used to feed air from an external source to the interior of the drive shaft. The air transfer chamber is formed so that concentrically around the drive shaft there is installed at least one element which is sealed around the drive shaft at both ends by seals so that the inner diameter of the element is essentially the same as the outer diameter of the drive shaft in the ends or in the vicinity of the ends of the element. Space for air in the air transfer chamber is formed so that the inner diameter of the element is greater than the outer diameter of the drive shaft on the area between the ends of the element. The air transfer chamber is provided with at least one connecting member which has connection with the external source of air. Because the air transfer chamber is separated from the bearings the air transfer chamber is removable and independent from the use or lifetime of the bearing housings.

For preferred air feeding in accordance with the invention, the drive shaft is provided with at least one opening between the external surface of the drive shaft and the interior of the drive shaft. This opening is so positioned and shaped that the opening has contact with the air transfer chamber essentially continuously in order to create a closed air feeding from the external air source to the rotor of the flotation machine. Thus air to be fed to the rotor is first flowed into the air transfer chamber and, thereafter, into the interior of the drive shaft and further through the rotor as dispersed bubbles into the slurry in the flotation machine.

The element forming the air transfer chamber is preferably installed in a non-fixed position to the drive shaft so that the element can be rotated between 0 and 360 degrees around the drive shaft. In one embodiment the element can also be installed so that the element is rotated with the drive shaft and the opening between the air transfer chamber and the interior of the drive shaft is kept essentially at the same position to the air transfer chamber. Then the opening can be a relatively small hole in the drive shaft, and the air transfer chamber can be shaped smaller and narrower, like a ring with a connecting member for feeding air into the interior of the drive shaft. Independent from the shape of the opening the opening has to be such that the opening allows a continuous air flow from the air transfer chamber into the interior of the drive shaft.

Using the device of the invention the initial assembly of the bearings is easier and cost effective and the maintenance is much easier to the prior art because the bearings and the air transfer chamber can be installed and changed separately. This also means that the bearing housing and the air transfer chamber can be rotated between 0 and 360 degrees around the drive shaft and thus advantageously the air transfer chamber can be installed in different positions to the bearings. The bearings can also be rotated around the drive shaft when installed in order to ensure that the bearing clearances are correct. The device of the invention eliminates the use of withdrawal sleeves and further simplifies the bearing assembly. Naturally, it is also possible to install at least one bearing housing and the air transfer chamber so that the bearing housing and the air transfer chamber are not able to rotate around the drive shaft and thus the bearing housing and the air transfer chamber are fixed to the drive shaft.

The invention is described in more details in the following referring to the enclosed drawing which illustrates one preferred embodiment of the invention as a partly-cut schematic side-view.

According to the drawing the flotation machine contains a flotation cell 1 with a feeding inlet 2 for slurry 3 to be treated, an over lip 4 for froth 5 created in the flotation cell 1 and a bottom outlet 6 for non-flotatable material. A drive shaft 7 is partly submerged in the slurry 3. The drive shaft 7 provided with a rotor 8 in the end submerged in the slurry 3 is used for mixing and transporting air to the rotor 8 of the flotation cell 1. Further, the rotor 8 is surrounded by a stator 9 installed in the flotation cell 1. The drive shaft 7 is driven by a drive arrangement 10 installed in the end of the drive shaft 7 opposite to the end submerged in the slurry 3. The drive shaft 7 is provided with two bearings 11 installed around the drive shaft 7 close to the drive arrangement 10. Between the bearings 11 there is installed an element 12 which forms a removable air transfer chamber 13 around the drive shaft 7. The drive shaft 7 is hollow in its interior between the air transfer chamber 13 and the rotor 8.

For air flowing from an external air source to the rotor 8 the element 12 for the air transfer chamber 13 is provided with at least one connecting member 14 which creates a connection between a connector 15 from an external air source and the air transfer chamber 13. Further, the drive shaft 7 is provided with at least one opening 16 between the air transfer chamber 13 and the interior 17 of the drive shaft 7. The opening 16 is so shaped that an essentially continuous air flow from the air transfer chamber 13 to the interior 17 of the drive shaft 7 is created.

During the operation of the flotation machine the drive shaft 7 is rotated by the drive arrangement 10. Then the opening 16 between the air transfer chamber 13 and the interior 17 of the drive shaft 7 is rotated, but a continuous air flow through the opening 16 is maintained.

What is claimed is:

1. Device for a flotation machine in which a drive shaft for mixing slurry and transporting air is driven by a drive arrangement and the drive shaft is provided with a bearing assembly and the drive shaft is at least partly hollow in the interior for transferring air to a rotor, characterised in that the drive shaft (7) is provided with at least two bearings (11) in a housing between which bearings (11) and separately installed from the bearings (11) there is positioned at least one element (12) forming an air transfer chamber (13) around the drive shaft (7), and the drive shaft (7) has at least one opening (16) in order to create an essentially continuous connection between the air transfer chamber (16) and the interior (17) of the drive shaft (7).

2. Device according to the claim 1, characterised in that the element (12) forming the air transfer chamber (13) is installed in a non-fixed position to the drive shaft (7).

3. Device according to the claim 1, characterised in that the element (12) forming the air transfer chamber (13) is fixed to the drive shaft (7).

4. Device according to the claim 1, characterised in that the drive shaft (7) has one opening (16) for the essentially continuous connection between the air transfer chamber (16) and the interior (17) of the drive shaft (7).

5. Device according to claim 1, characterized in that the element is removable and independent from the bearing housings.

* * * * *